US005967302A

United States Patent [19]

Lin

[11] Patent Number: 5,967,302

[45] Date of Patent: Oct. 19, 1999

[54] DUAL INLINE PACKAGE SWITCH

[76] Inventor: Hsi-Chi Lin, No. 72 Sec.3, Chung Hsin Rd., SanChung, Taipei, Taiwan

[21] Appl. No.: 09/036,551

[22] Filed: Mar. 6, 1998

[51] Int. Cl.[6] ..... H01H 15/00

[52] U.S. Cl. ..... 200/550; 200/16 D

[58] Field of Search ..... 200/16 R–16 D, 200/547–550

[56] References Cited

U.S. PATENT DOCUMENTS

| | | | |
|---|---|---|---|
| 4,376,234 | 3/1983 | Liataud et al. | 200/16 R |
| 4,454,391 | 6/1984 | Olsson | 200/16 D |
| 4,529,851 | 7/1985 | Priebe et al. | 200/16 D |
| 4,749,827 | 6/1988 | Wagatsuma et al. | 200/16 D |
| 4,841,105 | 6/1989 | Goodman et al. | 200/16 D |
| 4,926,012 | 5/1990 | De Beauvais | 200/16 R |
| 4,950,847 | 8/1990 | Billman et al. | 200/16 D |
| 5,065,276 | 11/1991 | Chou | 361/380 |

*Primary Examiner*—Michael A. Friedhofer
*Attorney, Agent, or Firm*—W. Wayne Liauh

[57] ABSTRACT

An improvement for dual inline package (DIP) switch includes a cover, a base and a plural number of actuators moveably housed in separated spaces formed between the cover and the base. Each actuator has a contact integrally formed thereunder by means of injection molding process. Each contact has two contact fingers extending at one side for making contact with two terminals located in the base to form an ON or OFF connection. The width and length of the actuator may be reduced up to 36% and 37% respectively vs. conventional DIP switch. The contact material may save up to 50% vs. a conventional DIP switch contact which extends to both sides of the switch. The foot of the actuator is integrally formed and therefore is more reliable and may function more smoothly.

3 Claims, 7 Drawing Sheets

DUAL INLINE PACKAGE SWITCH

BACKGROUND OF THE INVENTION

1. Field of the Invention

This invention relates to an improvement for dual inline package (DIP) switch and particularly to a DIP switch which uses one contact integrally formed with an actuator so that it becomes smaller size, lower cost to produce and more durable.

2. Description of the Prior Art

"Lighter, smaller, thinner and shorter" has become a widely pursuing trend in the design of electronic devices and electrical appliances nowadays. It is particularly notable in the notebook PC industry. Most producers put a great deal of investments and efforts trying to shrink the size and cut the weight of the PC related parts and peripherals. IC board is one of the key components under constant scrutinization in this respect. Some complex IC boards have included DIP switch. A smaller DIP switch will certainly help to cut the size of the IC board.

FIG. 1 shows a typical conventional DIP switch. It includes a cover A, a base B and a plural number of moveable actuators C. Each actuator C has a contact D riveted at the bottom thereof. The contact D is slantly extended at both sides of the base B and is firmly supported by a pair of spaced legs E from the bottom to prevent the contact D from deforming. By moving the actuator C in one way or another, the contact D will make contact or uncontact with the terminal F, then an ON or OFF connection will be established. A conventional DIP switch such as the one set forth above is difficult to shrink to a smaller size. It also has a number of drawbacks when trying to do so. E. g, when a finished product is under IR furnace process, the temperature of the DIP switch tends to rise faster and higher than IC board or other larger size parts. DIP switch is thus easier to deform than other large size parts. The riveting of the contact D to the actuator C is done by a separate operation and is difficult. The legs E has to be relatively short and small size. In the injection process, its dimensions become difficult to control. It is prone to form fluffy edges. When binding the cover A to the base B by high frequency welding, it could also happen that the legs E will stick to the base B. Furthermore, cutting the height of the legs E will reduce its supporting power to the contact D. The contact D is prone to deform during test or after long time of use. All this are problems existed in the conventional DIP switch waiting to be fixed.

SUMMARY OF THE INVENTION

In view of aforesaid disadvantages, it is therefore an object of this invention to provide a DIP switch improvement which has a contact extending to only one side instead of two sides so that the overall size of the switch may be reduced and overheat inducing defects may also be prevented.

It is another object of this invention to provide a DIP switch improvement in which the actuator and the contact are made integrally by injection molding process. The fabrication operation is thus simpler and the structure is also stronger and more reliable.

It is a further object of this invention to provide a DIP switch improvement in which the supporting leg of the actuator is integrally formed by injection molding process with the actuator so that the supporting power is stronger and the actuator motion is smoother.

It is yet another object of this invention to provide a DIP switch improvement which is small size and thus can save materials and production cost. It also facilitates packaging and transportation, and can reduce the space needed in an IC board.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
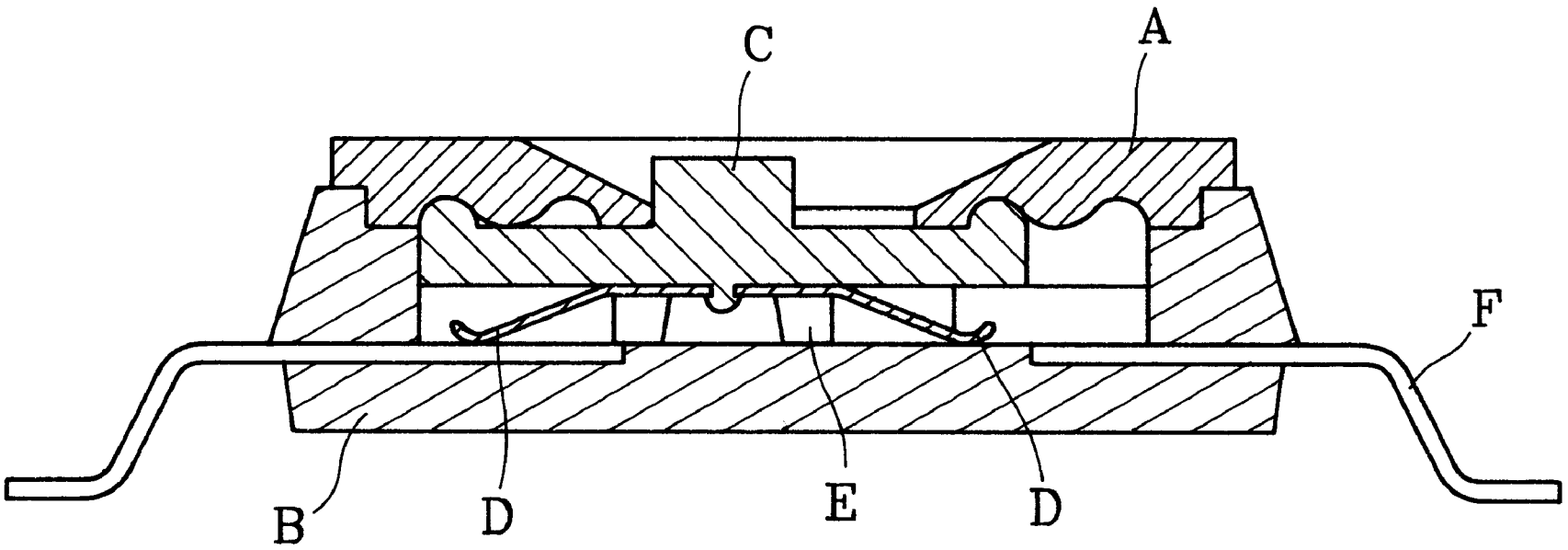
FIG. 1 (PRIOR ART)
FIG. 1 is a sectional view of a conventional DIP switch.
Figure 2:
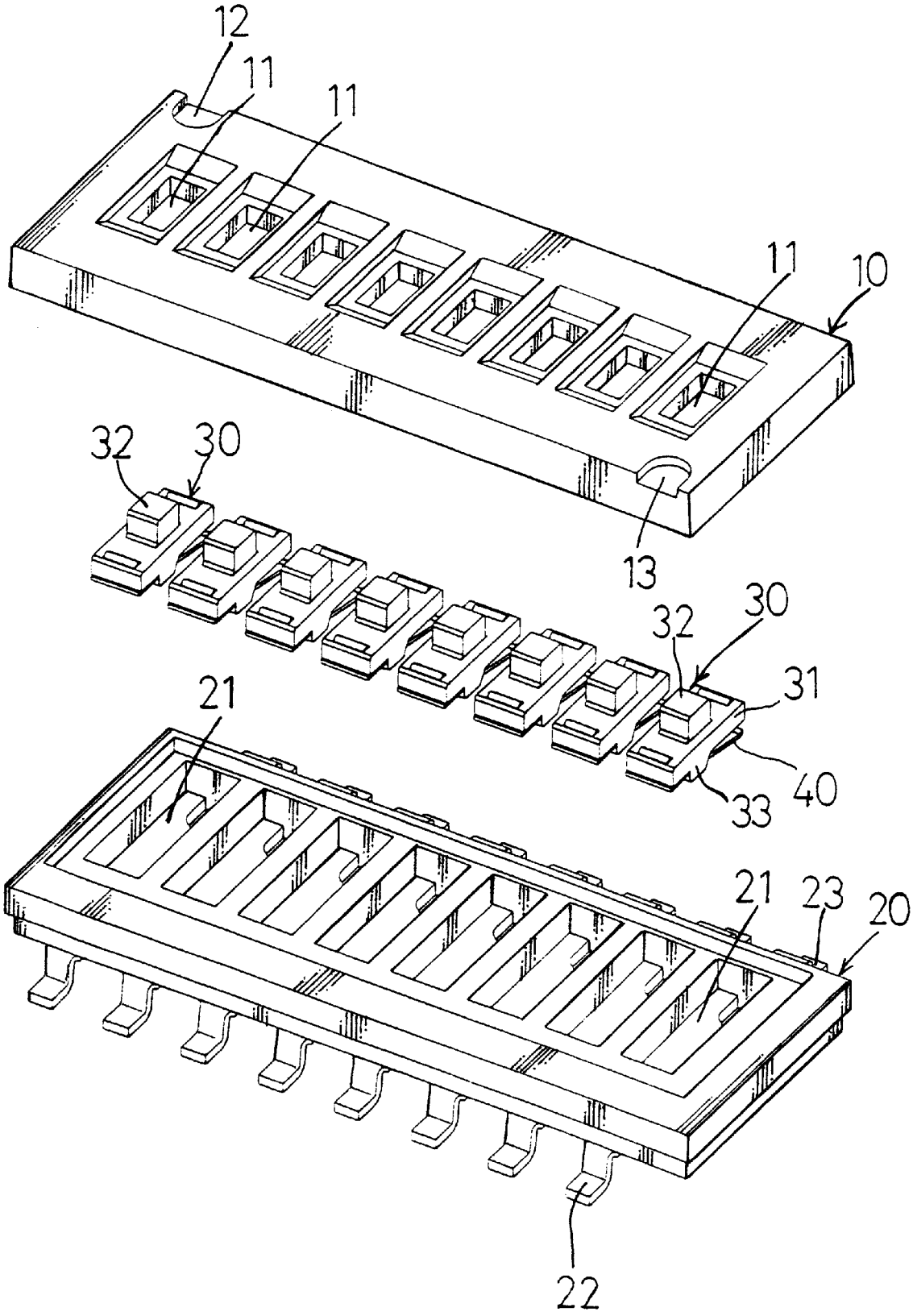
FIG. 2 is an exploded view of this invention.
Figure 3:
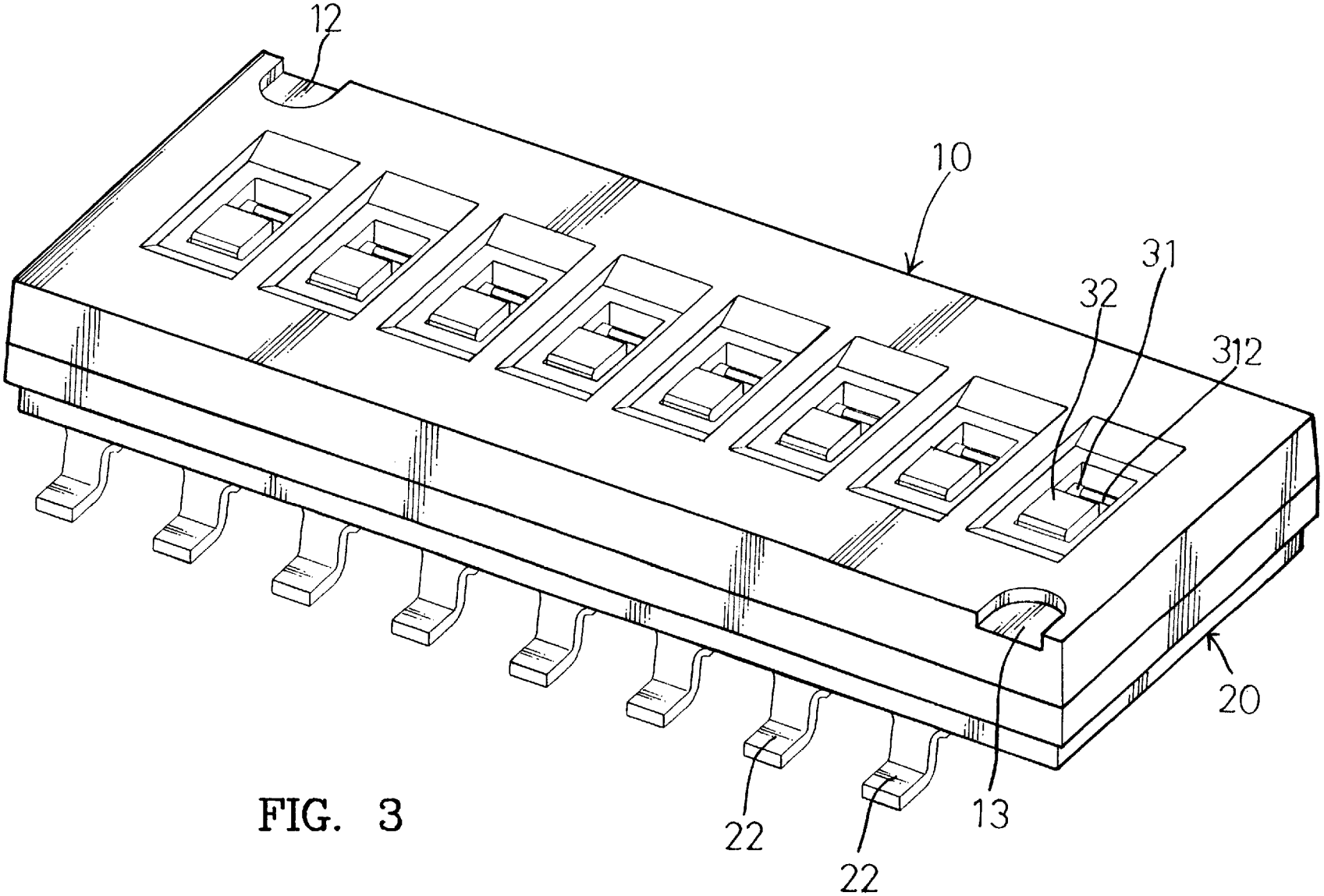
FIG. 3 is a perspective view of this invention.

Referring to FIGS. 2 and 3, the DIP switch according to this invention includes a cover 10, a base 20 and a plural number of actuators 30. The cover 10 is formed in a substantially rectangular shape with a plural number of cover troughs 11 equally spaced from each other.

Figure 4A:
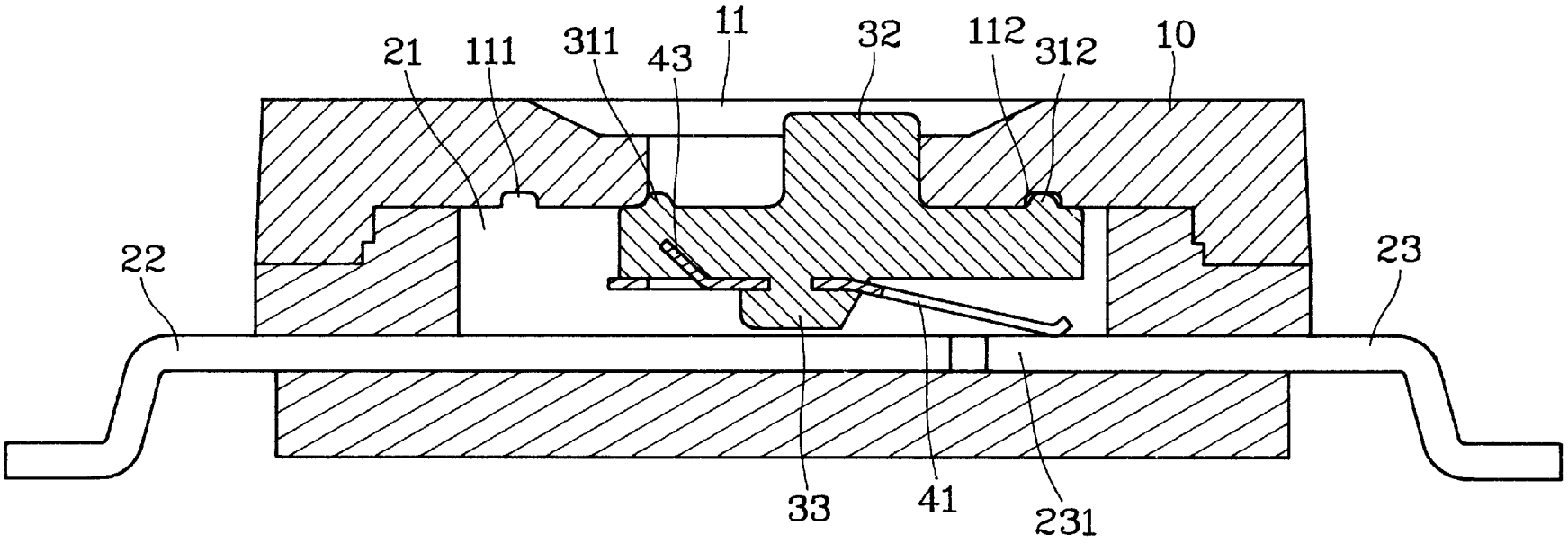
FIGS. 4A and 4B are sectional views of this invention at different use states.

At two diagonal corners of the cover 10, there are a pair of U-shaped recesses 12 and 13 formed. Referring to FIG. 4A, at the bottom of the cover 11, there are a pair of slots 111 and 112 formed at the central line of the cover trough 11.

The base 20 is located under the cover 10 and has a plural number of base troughs 21 mating with the cover troughs 11. When the cover 10 and the base 20 are assembled together, the cover trough 11 and the base trough 21 form a space allowing an actuator 30 moveably housed therein. Each base trough 21 has two terminals 22 and 23 fixed therein. The terminals 22 and 23 have one end extending outside the base 20, while another ends of the terminals 22 and 23 are located inside the base 20 and have respectively a terminal finger 221 and 231 overlapping with each other longitudinally, but spaced from each other (as shown in FIG. 5).

Figure 5:
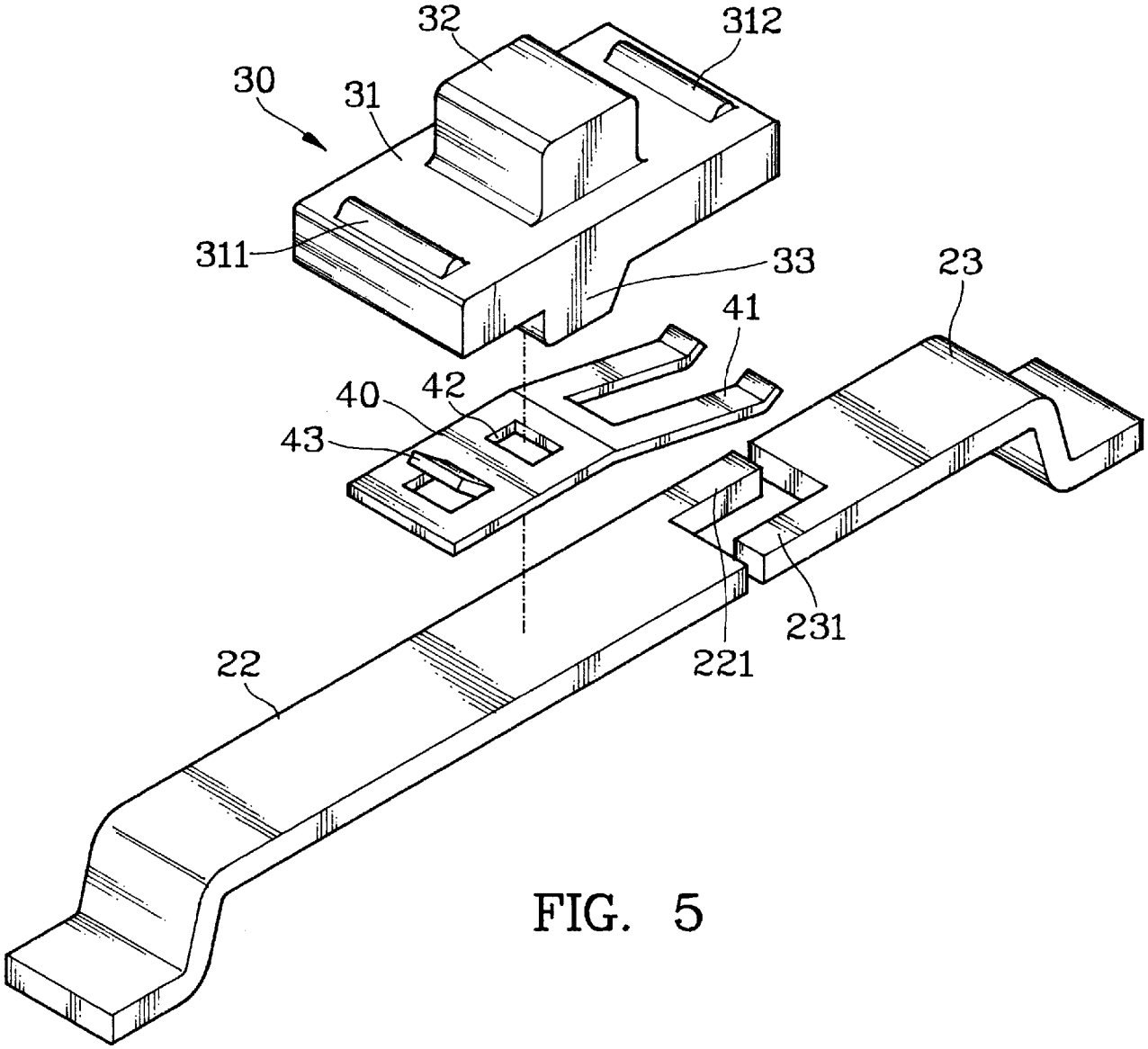
FIG. 5 is an exploded view of an actuator of this invention.

Referring to FIG. 5, an actuator 30 includes a button 32 on the top, a body 31 and a foot 33 which is integrally formed with a contact 40 to the body 31 by injection molding process. The contact 40 has one side slant and formed in a U-shape with two contact fingers 41, a bore 42 in the center for connecting the foot 33 to the body 31 and an upwardly tilted tongue 43 which may be embedded in the body 31 during the injection molding process (also referring to FIG. 4A). By means of this structure and process, the contact 40 may be firmly attached to the actuator body 31 and supported by the foot 33. On the top surface of two lateral ends of the body 31, there are a pair of bulges 311 and 312 which are engageable respectively with the slots 111 and 112. There are some distance between the bulges 311, 312 and the end edge of the body 31.

When in use (FIG. 4A), the actuator 30 is moved in one direction within the cover trough 11. The two contact fingers 41 make contact with the terminal fingers 221 and 231 simultaneously. Hence electrical contact is established between the terminals 22 and 23 through the contact 40. At this position, bulge 112 engages with the slot 312 while another end of the body 31 engages with one bottom side of the cover slot 11. The actuator 30 is thus held in position securely.

Figure 4B:
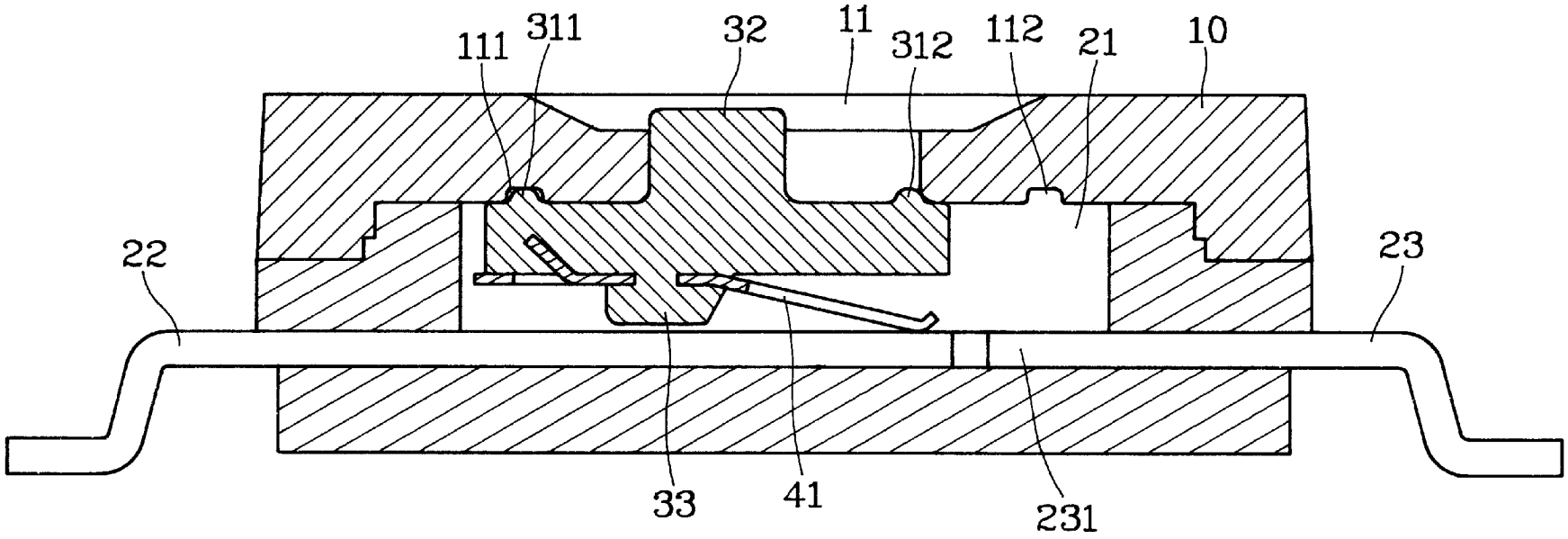

When moving the actuator 30 in another direction (FIG. 4B), the contact finger 41 disengages with the terminal fingers 221 and 231. The electrical contact between the terminals 22 and 23 is cut off. At that position, the bulge 311 and slot 111 are engaged while another end of the actuator 30 engages with another bottom side of the cover slot 11. The actuator 30 is also being held securely.

Figure 6:
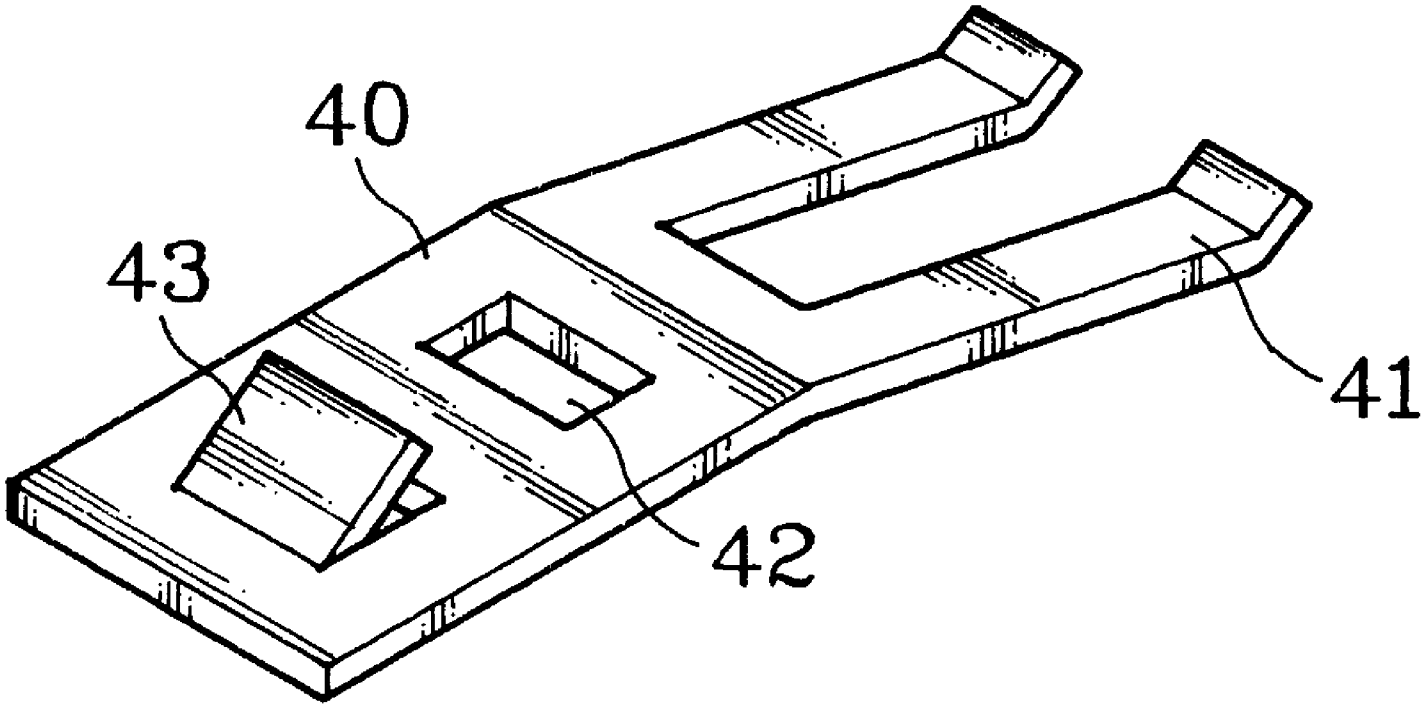
FIG. 6 is another embodiment of a contact of this invention.

FIG. 6 shows another embodiment of a contact 40 which has a tongue 43 projecting in another direction vs. the one shown in FIG. 5. It can provide same reinforcing effect to make the contact 40 firmly attached to the actuator body 31.

Since the foot 33 is integrally formed with the contact 40 and the body 31, the height of the foot may be made shorter and more precise. It also provides more supporting power to the contact 40. The production is simpler, the cost becomes lower and the movement of the actuator 30 is also smoother than conventional DIP switch.

As the contact 40 extends in only one direction rather than two directions, the terminal span (between terminal 22 and 23) may be reduced down to 1.27 m/m. It saves up to 50% of space (vs. 2.54 m/m for a conventional DIP switch). The size of the actuator 30 may be made down to 0.8 m/m in width and 2 m/m in length which are 36% and 37% less respectively than a conventional DIP switch. The material saving of the contact may be up to 50%. The space needed for the DIP switch on the IC board is thus much smaller.

The U-shaped recesses 12 and 13 on the diagonal end is to facilitate the peeling off of a protecting membrane which is usually used to cover the PC board (or circuit board) during fabrication process.

It may thus be seen that the objects of the present invention set forth herein, as well as those made apparent from the foregoing description, are efficiently attained.

What is claimed is:

1. An improvement for a dual inline package switch, comprising:

a cover shaped in substantially rectangular having a plural number of cover troughs equally spaced from each other;

a base located below the cover having a plural number of base troughs mating with said cover troughs, each of said base troughs having two terminals located at a bottom of said base trough, each of said two terminals having first one end extending outside of a respective lateral side of said base, also each terminal having a terminal finger at a second end of said terminal, and said terminal fingers are overlapping with and spaced from each other in the base; and plurality of actuators moveably housed in a space formed between said cover and said base, each of said actuators having a contact integrally formed thereunder by means of injection molding process, said contact having a slanted portion extended to one side of said actuator, said contact having a bore in a center of said contact for connecting with the actuator and said slanted portion of said contact having an U-shaped end with two contact fingers for making contact with the terminal fingers;

wherein the contact has a tongue slantly tilted upward in one direction at one end opposite to the U-shaped end.

2. An improvement for a dual inline package switch of claim 1, wherein the actuator has a foot located below a bottom at a middle portion of said contact.

3. An improvement for a dual inline package switch, comprising:

a cover shaped in substantially rectangular having a plural number of cover troughs equally spaced from each other;

a base located below the cover having a plural number of base troughs mating with said cover troughs, each of said base troughs having two terminals located at a bottom of said base trough, each of said two terminals having first one end extending outside of a respective lateral side of said base, also each terminal having a terminal finger at a second end of said terminal, and said terminal fingers are overlapping with and spaced from each other in the base; and a plurality of actuators moveably housed in a space formed between said cover and said base, each of said actuators having a contact integrally formed thereunder by means of injection molding process, said contact having a slanted portion extended to one side of said actuator, said contact having a bore in a center of said contact for connecting with the actuator and said slanted portion of said contact having an U-shaped end with two contact fingers for making contact with the terminal fingers;

wherein said contact has a tongue slantly tilted upward in another direction at one end opposite to the U-shaped end.

* * * * *